US006923223B2

(12) United States Patent
Trzmiel et al.

(10) Patent No.: US 6,923,223 B2
(45) Date of Patent: Aug. 2, 2005

(54) STORAGE DEVICE FOR A LIQUID MEDIUM

(75) Inventors: Alfred Trzmiel, Grafenberg (DE); Roland Meyer, Nürtingen (DE); Andreas Wild, Unterensingen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 50 days.

(21) Appl. No.: 10/626,408

(22) Filed: Jul. 24, 2003

(65) Prior Publication Data

US 2004/0154694 A1 Aug. 12, 2004

(30) Foreign Application Priority Data

Jul. 24, 2002 (DE) ..... 102 33 481

(51) Int. Cl.[7] ..... B67C 3/02
(52) U.S. Cl. ..... 141/113; 141/104; 141/114; 138/30
(58) Field of Search ..... 141/18, 20–27, 141/67, 100, 104, 113, 114, 314; 138/30, 31

(56) References Cited

U.S. PATENT DOCUMENTS 3,477,195 A * 11/1969 Chambers ..... 53/470
6,189,572 B1 * 2/2001 Ruffer et al. ..... 138/30

FOREIGN PATENT DOCUMENTS

DE 100 29 903 3/2002
WO 99/17029 4/1999

* cited by examiner

*Primary Examiner*—Timothy L. Maust
(74) *Attorney, Agent, or Firm*—Gudrun E. Huckett

(57) ABSTRACT

A storage device for a liquid medium has a housing having an interior provided with at least one partitioning element dividing the interior into a first chamber for receiving the liquid medium and into a second chamber filled at least partially with a gas under pressure. The gas keeps the liquid medium in the first chamber under pressure. The at least one partitioning element is formed at least partially of an expandable bellows fastened pressure-tightly to a lid of the housing.

21 Claims, 9 Drawing Sheets

STORAGE DEVICE FOR A LIQUID MEDIUM

BACKGROUND OF THE INVENTION

1. Field of the Invention

The invention relates to a storage device for a liquid medium that is received in a receiving chamber of a housing and separated by at least one partitioning element from a chamber filled at least partially with a gas that is under pressure and keeps the liquid medium in the receiving chamber under pressure.

2. Description of the Related Art

In the automotive field, piston and membrane storage devices are used which have two separate variable volume chambers separated from one another by a piston or a membrane or diaphragm. The storage device serves as a reservoir for a liquid medium, usually oil, contained in a first one of the chambers and maintained under pressure by a gas located in the second chamber. The storage devices can be adapted by variation of their size and the preload pressure of the gas to different requirements and conditions of use. Depending on the temperature and the pressure range, the piston as well as the membrane are prone to leak, i.e., the gas escapes from the gas chamber via the piston seal or by diffusion via the membrane. Particularly membrane storage devices are very susceptible to diffusion. By providing multi-layer membranes, diffusion can be reduced; however, it cannot be completely prevented. Accordingly, over the service life of the storage device the gas pressure in both systems will decrease gradually; this leads to a limitation of the usable pressure range and a reduction of the available storage volume. Large temperature differences in operation, combined with large piston or membrane movements, increase gas loss. In addition, the membrane is susceptible to tearing in the case of large deformations at low temperatures. Conventional gases are, for example, nitrogen ($N_2$) or carbon tetrafluoride ($CF_4$) as well as a mixture of these gases. The gas to be used is selected depending on the range of temperature of the respective application as well as the permissible diffusion, i.e., the permissible gas loss over the service life of the device. The materials of the piston seal and of the membrane must be matched to the media employed in the device. Otherwise, depending on the medium, swelling of the seal or gasket or failure of the membrane can be the result.

SUMMARY OF THE INVENTION

It is an object of the present invention to configure the storage device of the aforementioned kind such that a reliable operation over the service life of the storage device is ensured.

In accordance with the present invention, this is achieved in that the partitioning element is formed at least partially by an expandable bellows.

In the storage device according to the invention, the receiving chamber for the liquid medium and the chamber for the gas are separated from one another by an expandable bellows. The volume change of this bellows is realized by a geometric change of the bellows folds. The connecting locations of the bellows can be simply welded in a pressure-tight way to other components. The bellows itself is reliably seal-tight so that the gas can neither escape through the bellows nor through sealing locations.

DESCRIPTION OF THE PREFERRED EMBODIMENTS

The storage device to be described in the following serves as a reservoir for a liquid medium, usually oil, and is used in the automotive industry. For example, such storage devices can be used in electronic-hydraulic control device for transmissions of motor vehicles; this will be explained in more detail in an exemplary fashion in connection with FIG. 16. With these control devices, the gutters and gears of the transmission can be selected in an automatically controlled manual transmission (direct shift gearbox).

Figure 1:
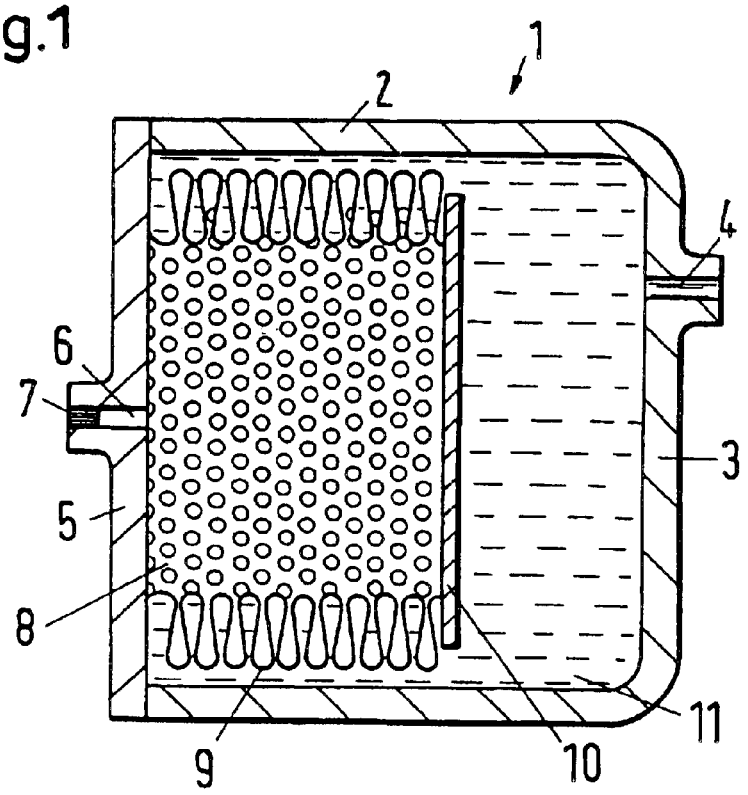
FIG. 1 shows a section of the storage device according to the present invention at maximum system pressure.
Figure 2:
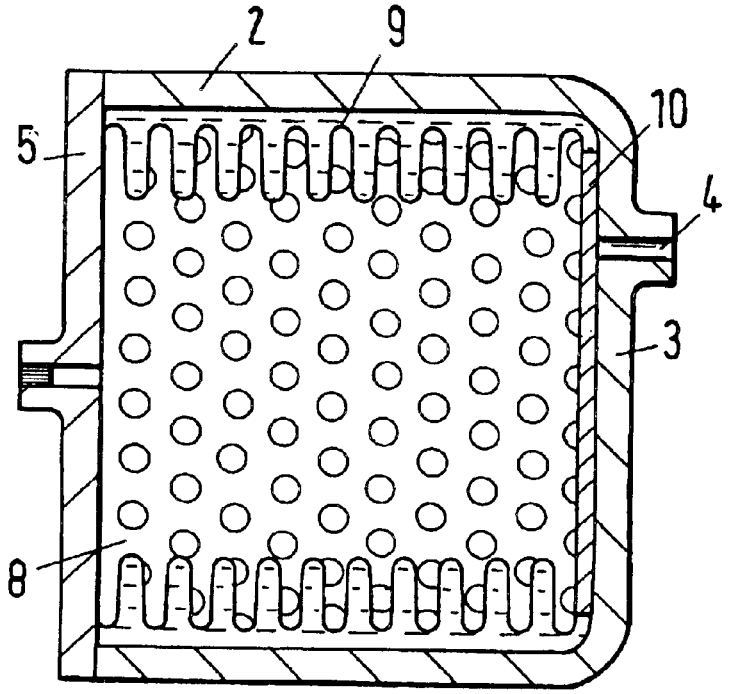
FIG. 2 shows the storage device according to FIG. 1 at minimum system pressure.

In the embodiment according to FIG. 1 and FIG. 2, the storage device has a cup-shaped housing 1 with a cylindrical housing jacket 2 and a housing bottom 3. At least one opening 4 is provided as a pressure connector in the housing bottom 3 by which the interior of the housing is in communication with a hydraulic system. A lid 5 is attached to the end face of the housing jacket 2 which has at least one filling opening 6 for a pressure medium, preferably gas. The filling opening 6 is closed by means of a closure member 7 in a pressure-tight way. The filling opening 6 can be closed, for example, by welding. Also, it is possible to provide the filling opening with a check valve which ensures a pressure-tight closure.

The filling opening 6 opens into a chamber 8 delimited by a portion of the lid 5 and the partitioning element comprising bellows 9 and bottom part 10. The lateral bellows 9 forms the sidewall of the chamber 8 and is connected with a first end in a pressure-tight way to the inner side of the lid 5. The bottom part 10 is also connected in a pressure-tight way to the other end of the bellows 9. The bellows 9 is advantageously made of stainless steel.

The disk-shaped lid 5 is connected along its edge in a pressure-tight way to the housing jacket 2, for example, by welding or gluing.

The housing jacket 2 surrounds the bellows 9 at a distance. In this way, the medium supplied to the housing 1, for example, oil or another liquid, can flow into the space defined between the housing jacket 2, the bellows 9, and the housing lid 5, which space is the housing chamber 11. The medium contained in the housing chamber 11 is subjected to a system pressure $p_s$ while the gas contained in the chamber 8 is under the gas pressure $p_g$. The bellows 9 is seal-tight so that the gas enclosed by it cannot escape into the housing chamber 11. For filling the chamber 8, any suitable gas can be used, in particular, nitrogen or carbon tetrafluoride.

FIG. 1 shows the situation in which the medium contained in the housing chamber 11 is subjected to maximum system pressure $p_{max}$. This has the result that the bellows element 9, 10 is compressed by elastic deformation of the bellows 9 until the pressure $p_g$ of the gas contained in the chamber 8 corresponds to the maximum pressure $p_{max}$ of the medium contained in the housing chamber 11. The pressure $p_g$ of the gas in the chamber 8 is determined as follows.

$$p_g = p_{system} - \text{stroke of bellows} \times \text{spring rate of the bellows } \mathbf{9}.$$

FIG. 2 shows the situation with minimum system pressure. The bellows 9 is expanded by the pressure $p_g$ of the gas contained in the chamber 8. In the illustrated example, the bellows 9 is expanded to such an extent that the bottom part 10 rests against the housing bottom 3. The pressure $p_g$ of the gas in the chamber 8 corresponds to the minimum pressure $p_{min}$ of the gas. The volume $V_g$ of the gas in the chamber 8 corresponds to the maximum volume $V_{max}$.

The bottom part 10 closes the opening 4 when the bellows 9 is in its maximum expansion position so that no medium of the hydraulic system can reach the housing chamber 11. This has the result that the pressure $p_D$ of the medium present in the area between the bellows 9 and the housing jacket 2 corresponds to the pressure $p_g$ of the gas in the chamber 8.

The bellows element 9, 10 is comprised of steel, preferably stainless steel, and can therefore be used within a very large range of temperatures of use. It is possible to use this bellows storage device in aeronautics and aerospace industries where very great temperature fluctuations are encountered. The filling gas can be any suitable gas because it cannot diffuse from the chamber 8 into the chamber 11 through the bellows 9. In this way, gas loss does not occur and the least expensive available gas can be used. The hydraulic medium, which reaches via the opening 4 the housing chamber 11, can be almost any liquid because the bellows 9 made of stainless steel is insensitive with regard to most liquids and to corrosion. If needed, the housing 1 and the lid 5 can also be made of stainless steel.

The bellows element 9, 10, depending on its configuration and geometry, can be filled up to a certain differential pressure between the inner and outer side. When a higher preload pressure of the gas is required in the bellows element 9, 10, a corresponding counterpressure can be provided by the system (inner chamber 11 of the housing) so as to maintain a differential pressure below the permissible limit. For this purpose, the inner chamber 11 is filled with so much oil that no air is present in the housing chamber 11 and the bellows 9 with the bottom part 10 just closes off the openings 4 in a seal-tight way. Subsequently, the filling pressure of the bellows storage device 9, 10 can be increased almost to any desired level because the pressure on the exterior of the bellows 9 increases without causing deformation of the bellows as a result of the medium present in the housing chamber 11, which medium that is to be considered incompressible; in this way the bellows cannot be damaged.

In order to prevent damage of the bellows after gas has been filled into the chamber 8 when the pressure in the hydraulic system drops below the gas preload pressure, the counterpressure is maintained at the preload pressure level by closing the bore 4 on the oil supply side. This can be achieved by the bellows 9 itself or by the bottom part 10 which at maximum bellows stroke rests against the housing bottom 3 of the housing 1 and closes off the opening 4. With a corresponding configuration of the opening 4 on the inner side of the housing 1, seal-tightness of this closure can be ensured. When during operation the pressure in the housing chamber 11 increases past the adjusted preload pressure in the chamber 8, the bottom part 10 of the bellows 9 is pushed back and, in this way, the opening 4 is released. The storage device can then fulfill its function. The gas volume in the chamber 8 can be reduced by means of the closure member 7 or by means of an incompressible medium that is not miscible with the filling gas, for example, oil. In this way, the pressure/filling volume characteristic line of the bellows storage device can be adjusted to the maximum permissible bellows stroke.

Figure 3:
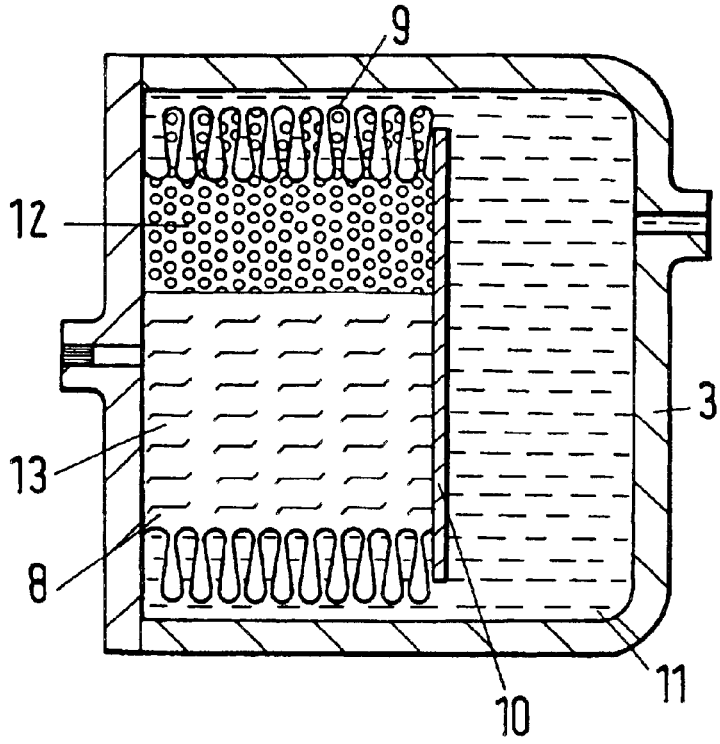
FIG. 3 shows a second embodiment of the storage device according to the present invention in a representation corresponding to FIG. 1.
Figure 4:
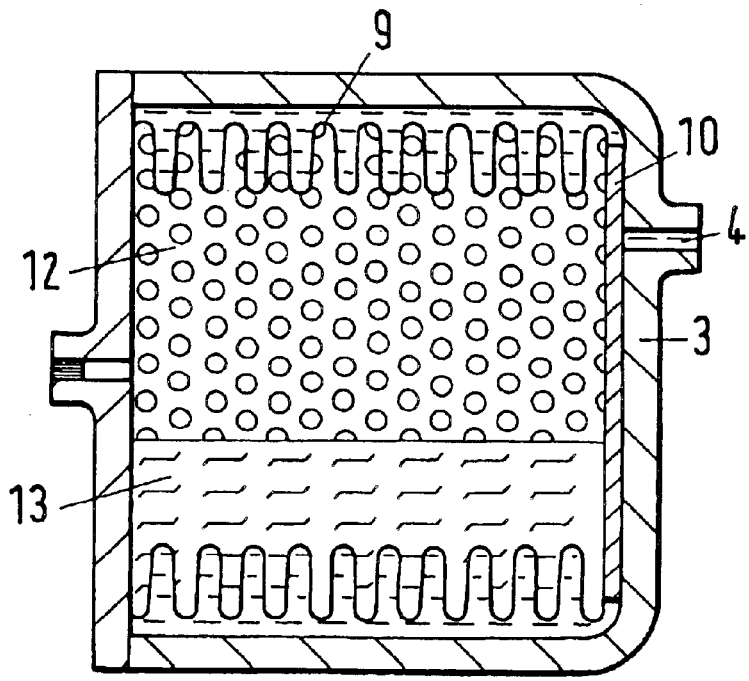
FIG. 4 shows the second embodiment of the storage device according to the present invention in a representation corresponding to FIG. 2.

In the embodiment according to FIGS. 3 and 4, in the chamber 8 of the bellows element 9, 10 not only a gas but also an incompressible medium 13 in the form of liquid, for example, oil, is present. The gas 12 and the medium 13 do not mix with one another.

In comparison to the preceding embodiment, the gas volume is reduced by use of the liquid 13. By means of the liquid 13, the pressure/filling volume characteristic line can be adjusted with respect to its gradient. In comparison to filling the chamber 8 with gas only (FIGS. 1 and 2), the pressure/filling volume characteristic line becomes steeper, when the incompressible medium 13 is used in the chamber 8. By means of the mixing ratio of gas 12 and liquid 13 the pressure increase can thus be optimally adjusted via the stroke.

The storage device according to FIGS. 3 and 4 is otherwise embodied in the same way as the preceding embodiment. FIG. 3 shows the situation in which the system pressure in the housing chamber 11 corresponds to maximum pressure $p_{max}$. Correspondingly, the deformation of the bellows 9 has caused the bottom part 10 to be retracted to such an extent that it is spaced from the housing bottom 3.

FIG. 4 shows the situation where the system pressure $p_{min}$ is at minimum. The bellows 9 has correspondingly expanded to such an extent that the bottom part 10 rests against the inner side of the housing bottom 3 and closes off the opening 4. The volume of the gas contained in the chamber 3 is $V_{max}$ in this case, while the volume of the liquid 13 has remained unchanged. The gas volume V in the chamber 8 is $V_{min}$ for maximum system pressure. This results in the following equation.

$$p_{min}/p_{max}=V_{max}/V_{min}.$$

Figure 5:
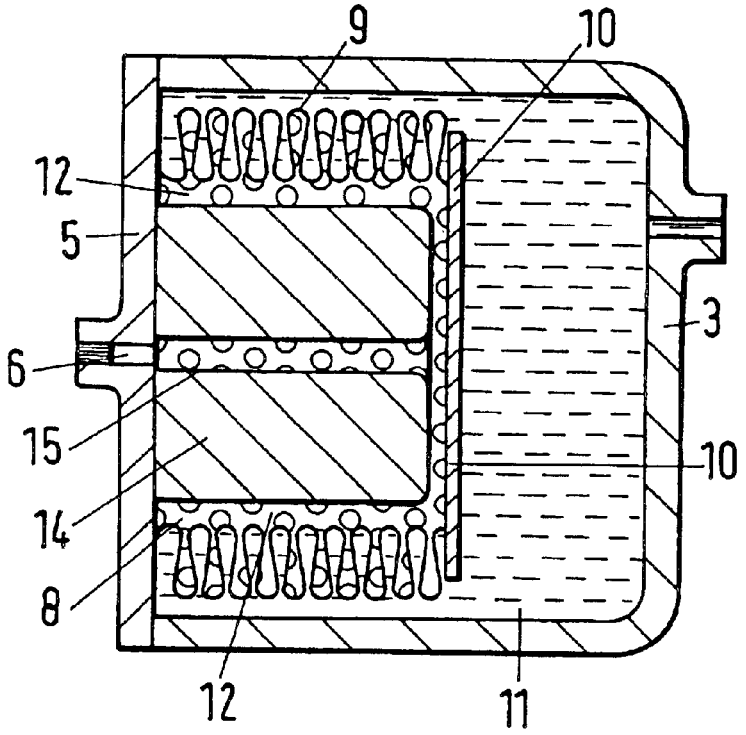
FIG. 5 shows a third embodiment of the storage device according to the present invention in a representation corresponding to FIG. 1.
Figure 6:
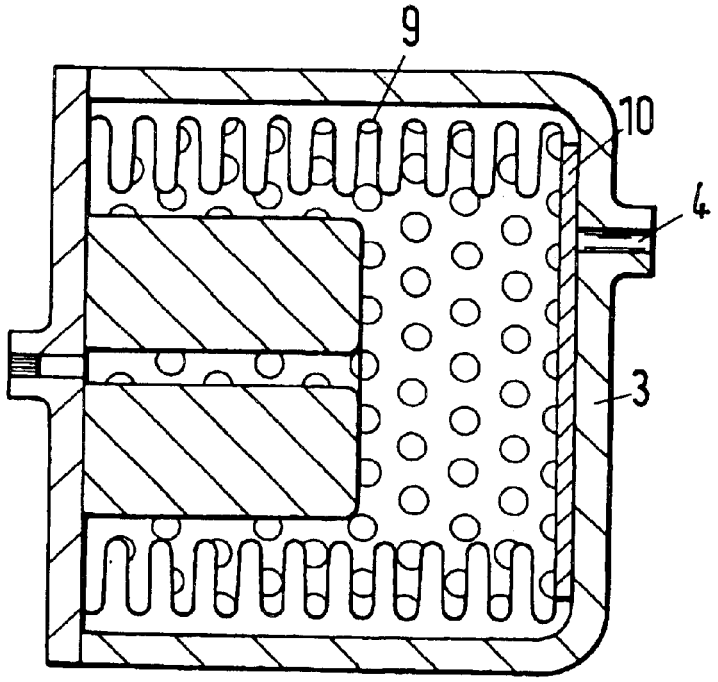
FIG. 6 shows the third embodiment of the storage device according to the present invention in a representation corresponding to FIG. 2.

FIG. 5 and FIG. 6 show a storage device with the bellows element 9, 10 in whose chamber 8 the gas 12 is located. Similar to the embodiment according to FIG. 3 and FIG. 4, the gas volume is reduced in comparison to the embodiment according to FIG. 1 and FIG. 2. In contrast to the embodiment according to FIG. 3 and FIG. 4, the volume reduction of the gas 12 is realized by a solid body 14 which is fastened on the inner side of the lid 5. It has at least one through opening 15 which connects the filling opening with the chamber 8. The solid body 14 is a filling member whose size depends on the desired volume reduction of the gas 12. The bellows 9 surrounds the solid body 14 at a spacing.

Otherwise, the storage device according to FIG. 5 and FIG. 6 is identical to the embodiment according to FIG. 1 and FIG. 2. In the illustration according to FIG. 5, maximum system pressure $p_{max}$ is present In the housing chamber 11. The bottom part 10 in this way is spaced from the housing bottom 3. The bellows element 9, 10 is configured such that the bottom part 10 has a spacing from the solid body 14 at maximum system pressure.

FIG. 6 shows the conditions when the system pressure is at minimum ($p_{min}$). As in the preceding embodiments, the bottom part 10 of the bellows storage device rests against the inner side of the housing bottom 3 and closes off the opening 4 in the housing bottom 3.

By selecting a proper size of the solid body 14, the pressure/filling volume characteristic line of the bellows storage device can be optimally adjusted.

Figure 7:
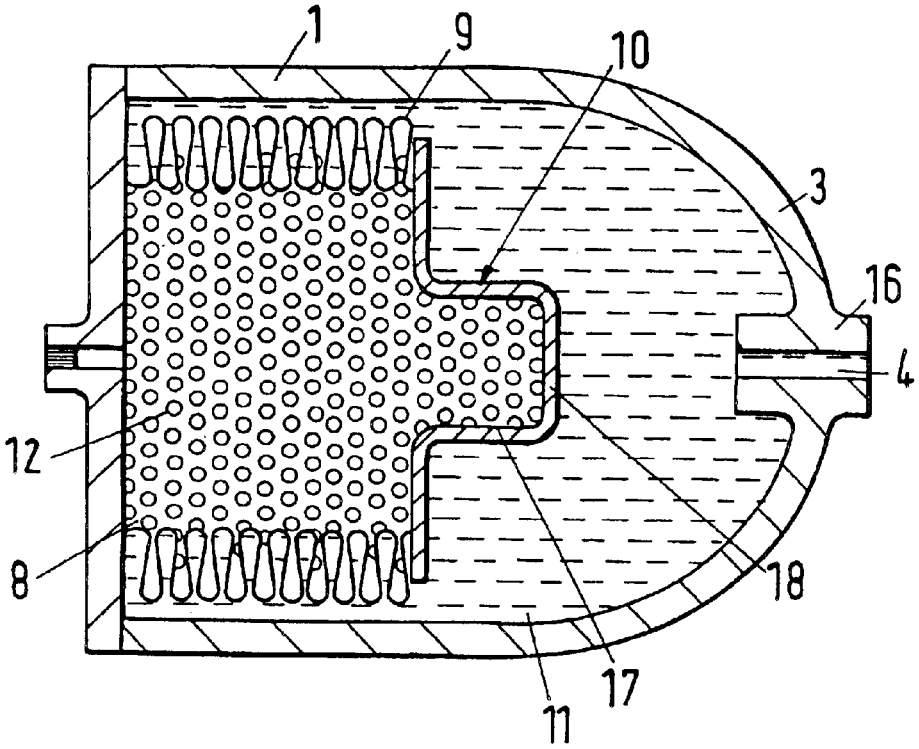
FIG. 7 shows a fourth embodiment of the storage device according to the present invention in a representation corresponding to FIG. 1.
Figure 8:
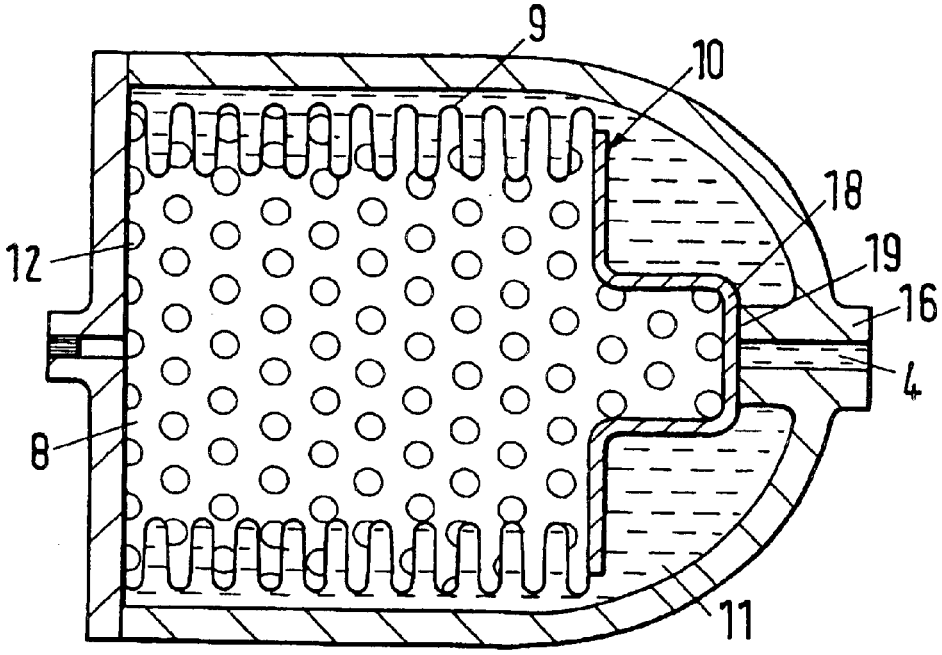
FIG. 8 shows the fourth embodiment of the storage device according to the present invention in a representation corresponding to FIG. 2.

FIG. 7 and FIG. 8 show a bellows storage device which is basically of the same configuration as the embodiment according to FIG. 1 and FIG. 2. The difference resides only in the special shape of the housing 1 and of the bottom part 10 of the bellows element 9, 10. The housing bottom 3 is spherical and has centrally an opening 4 which connects the housing chamber 11 with the hydraulic system. The opening 4 is provided in the projection 16 of the housing bottom 3 which projects inwardly and outwardly.

The bottom part 10 of the bellows element 9, 10 has centrally a cylindrical projection 17 which extends in the direction toward the projection 16 of the housing 1 and has a plane bottom part 18. The bellows 9 is fastened on the edge of the bottom part 10, as in the preceding embodiments. Within the bellows element 9, 10, the gas 10 is provided which completely fills the chamber 8.

FIG. 7 shows the conditions for maximum system pressure $p_{max}$. The bottom part 18 of the bottom part 10 has a spacing from the housing projection 16. The gas 12 has minimum volume $V_{min}$ .

FIG. 8 shows the conditions for minimal system pressure $p_{min}$. As a result of the minimum system pressure, which is smaller than the gas pressure in the chamber 8, the bellows 9 is expanded until the bottom part 18 of the bottom part 10 rests against the plane end face 19 of the part of the projection 16 projecting into the housing chamber 11 and closes off the opening 4. The gas 12 in the chamber 8 has thus maximum volume $V_{max}$.

Figure 9:
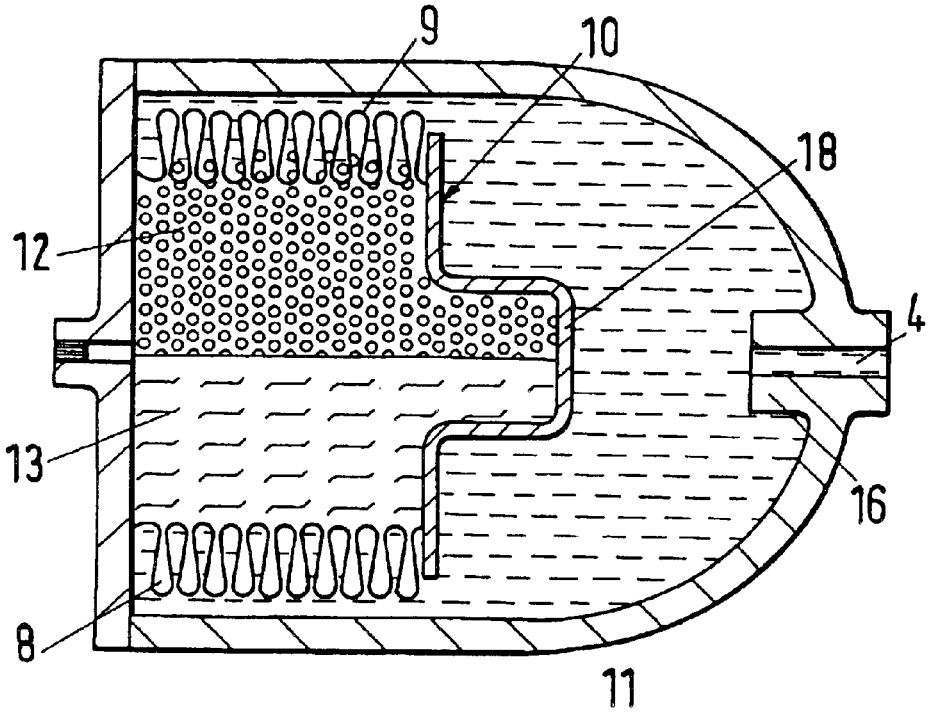
FIG. 9 shows a fifth embodiment of the storage device according to the present invention in a representation corresponding to FIG. 1.
Figure 10:
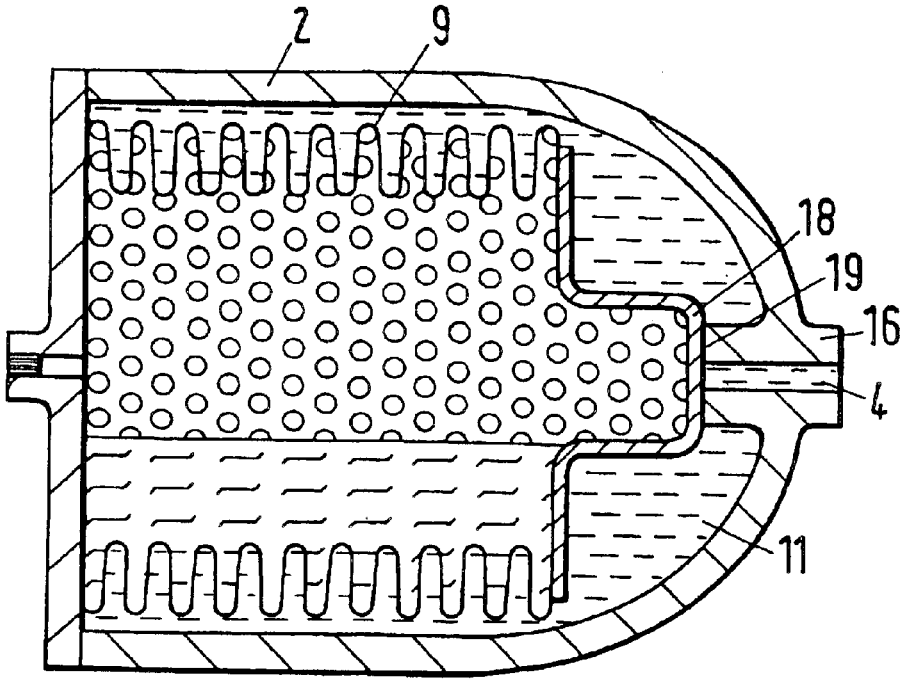
FIG. 10 shows the fifth embodiment of the storage device according to the present invention in a representation corresponding to FIG. 2.

The embodiment according to FIG. 9 and FIG. 10 corresponds substantially to the embodiment of FIG. 7 and FIG. 8. In the chamber 8 of the bellows element 9, 10, in accordance with the embodiment of FIG. 3 and FIG. 4, an incompressible medium 13, for example, oil, is provided in addition to the gas 12. The incompressible medium 13 reduces the gas volume in the bellows element 9, 10, as has been explained in connection with FIG. 3 and FIG. 4.

FIG. 9 shows the position of the bellows 9 when the system pressure in the housing chamber 10 is at maximum. In this case, the bellows 9 is compressed to such an extent that the inner pressure in the chamber 8 corresponds to that of the externally acting system pressure. The bottom part 18 has a spacing from the housing projection 16 so that the housing chamber 10 is connected with the hydraulic system by means of the opening 4.

FIG. 10 shows the situation where the pressure in the housing chamber 10 is at minimum. The bottom part 18 rests against the plane end face 19 of the projection 16 and closes off the opening 4. As in the preceding embodiments, the housing jacket 2 surrounds the bellows 9 at a spacing so that the medium contained in the housing chamber 11 can flow into the area between the housing jacket 2 and the bellows 9.

Figure 11:
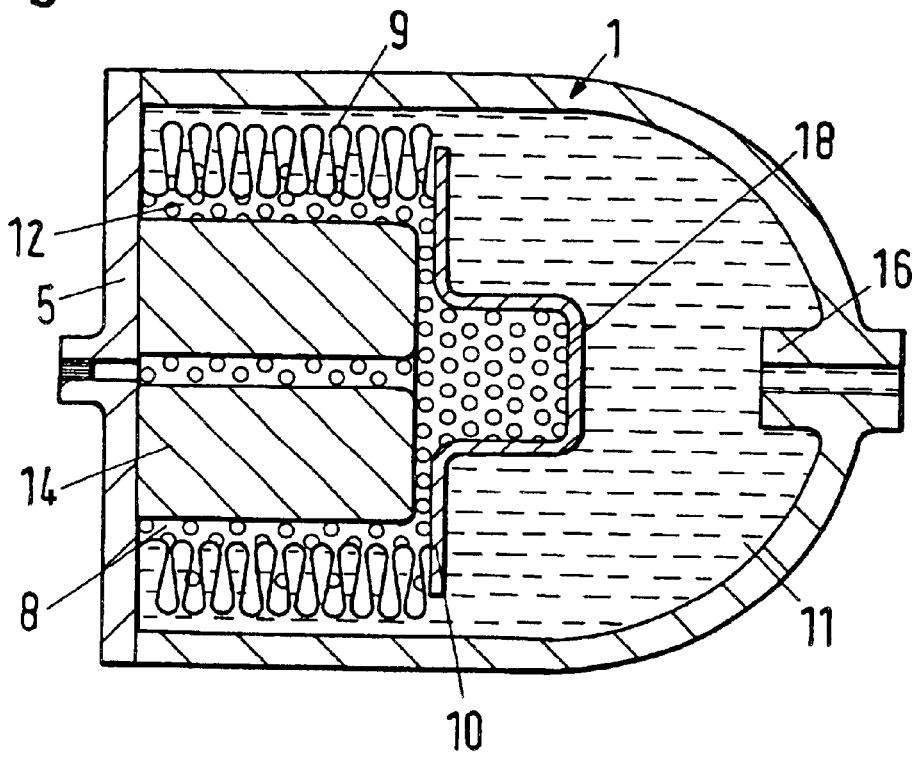
FIG. 11 shows a sixth embodiment of the storage device according to the present invention in a representation corresponding to FIG. 1.
Figure 12:
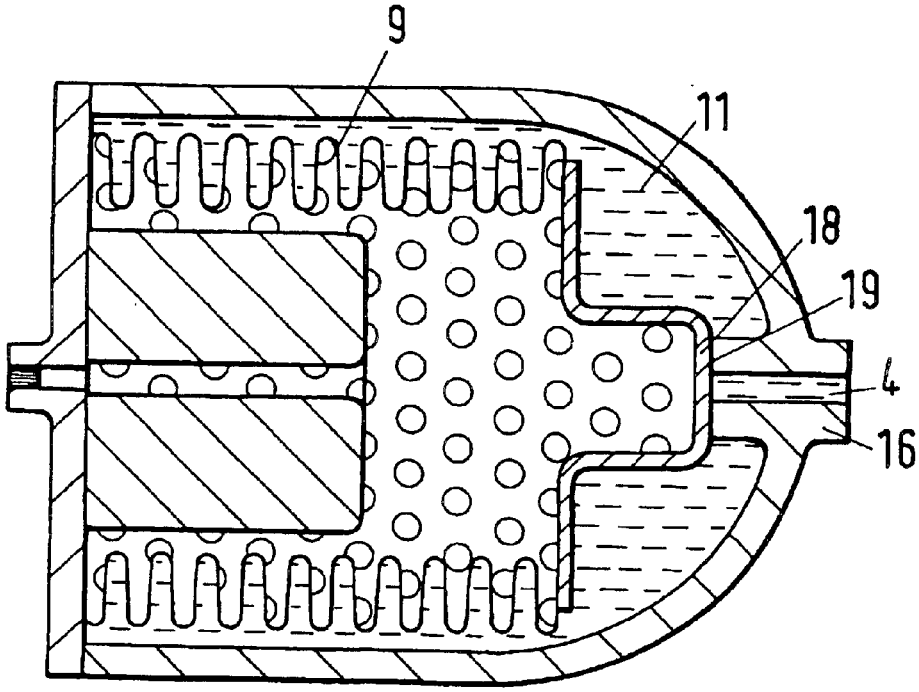
FIG. 12 shows the sixth embodiment of the storage device according to the present invention in a representation corresponding to FIG. 2.

The embodiment according to FIGS. 11 and 12 corresponds essentially to the embodiment according to FIG. 7 and FIG. 8. The only difference is that in the chamber 8 of the bellows element 9, 10, in accordance with the embodiment of FIG. 5 and FIG. 6, a solid body 14 is provided in addition to the gas 12. Depending on the size of the solid body 14, the gas volume in the chamber 8 is different. The body 14 is identical to the embodiment according to FIG. 5 and FIG. 6 and also connected to the lid 5.

FIG. 11 shows the situation in which the system pressure in the housing chamber 11 is at maximum ($p_{max}$) so that the bottom part 18 is spaced from the projection 16 of the housing 1.

FIG. 12 shows the situation in which the system pressure in the housing chamber 11 is at minimum ($p_{min}$). The bellows 9 is expanded to such an extent that the bottom part 18 rests against the end face 19 of the projection 16 and closes off the opening 4.

Figure 13:
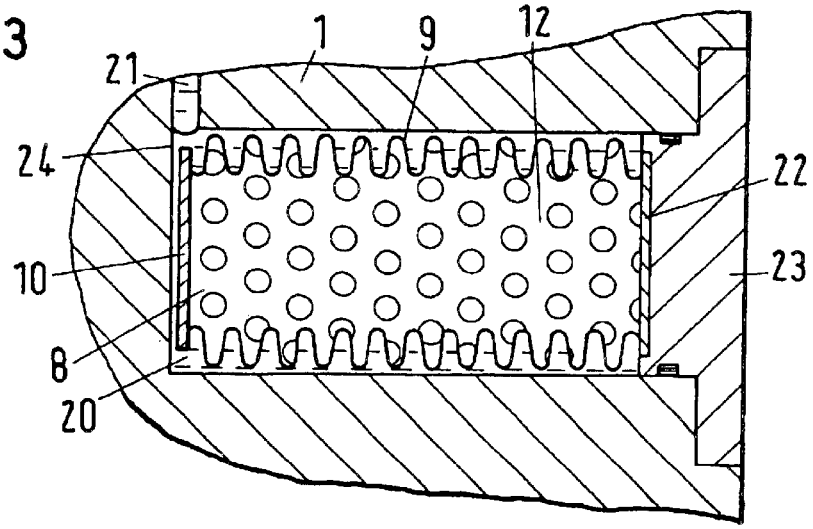
FIG. 13 shows a seventh embodiment of the storage device according to the present invention in a representation corresponding to FIG. 1.
Figure 14:
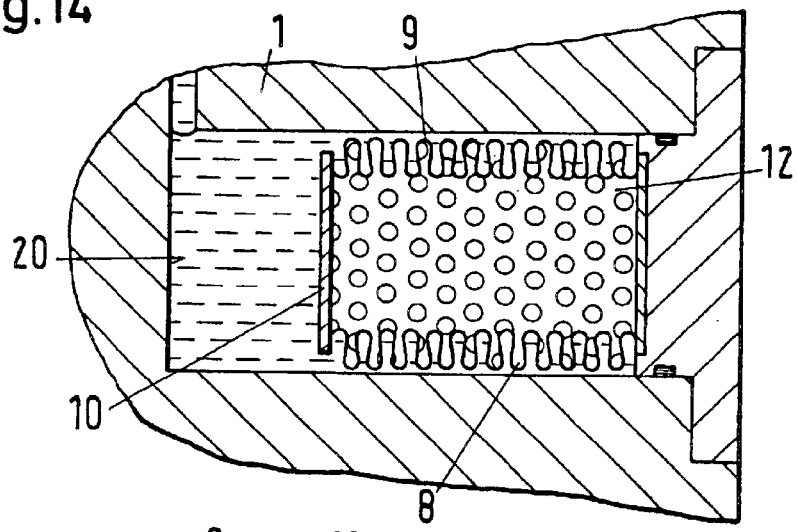
FIG. 14 shows the seventh embodiment of the storage device according to the present invention in a representation corresponding to FIG. 2.

FIG. 13 and FIG. 14 show the bellows storage device mounted in a control device for automatically controlled manual transmissions of vehicles. The control device will be explained in more detail in connection with FIG. 16. It has a housing 1 with a receptacle 20 for the bellows element 9, 10. A pressure bore 21 opens into the receptacle 20 via which the medium is supplied at system pressure to the receptacle 20. The gas 12 is contained in the bellows element 9, 10. At the end opposite the bottom part 10, the bellows element 9, 10 is provided with a plate-shaped fasting part 22 which closes off the chamber 8 of the bellows storage device and with which it rests against the closure 23 of the receptacle 20. The closure 23 is inserted in a sealed fashion into the receptacle 20 and closes off the receptacle 20 tightly.

According to FIG. 13, the system pressure $p_{min}$ is minimal so that the bellows 9 has expanded to such an extent that the bottom part 10 of the bellows element 9, 10 rests against the wall 24 of the receptacle 20 neighboring the pressure bore 21. The bellows 9 is arranged such in the receptacle 20 that the medium supplied via the pressure bore 21 can reach the space defined between the bore wall, the bellows 9, and the closure 23.

When the system pressure is at maximum ($p_{max}$—FIG. 14), the bellows element 9, 10 is compressed until the pressure of the gas 12 in the chamber 8 corresponds to the maximum system pressure $p_{max}$.

The bellows storage device according to FIGS. 13 and 14 can be provided corresponding to the embodiments of FIG. 3 and FIG. 4 as well as FIG. 5 and FIG. 6 with an incompressible medium 13 or with a solid body 14 in addition to the gas 12 in order to adjust the pressure/filling volume characteristic line to the respective application.

Figure 15:
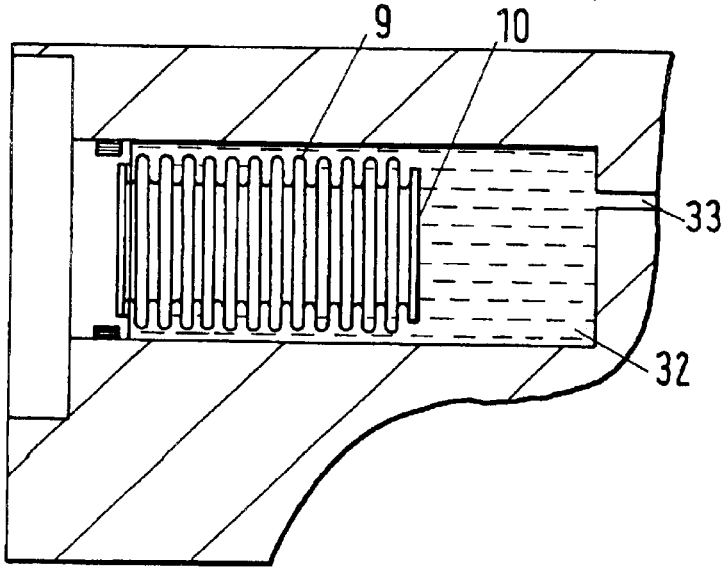
FIG. 15 is a section of an eighth embodiment of the storage device according to the present invention.
Figure 16:
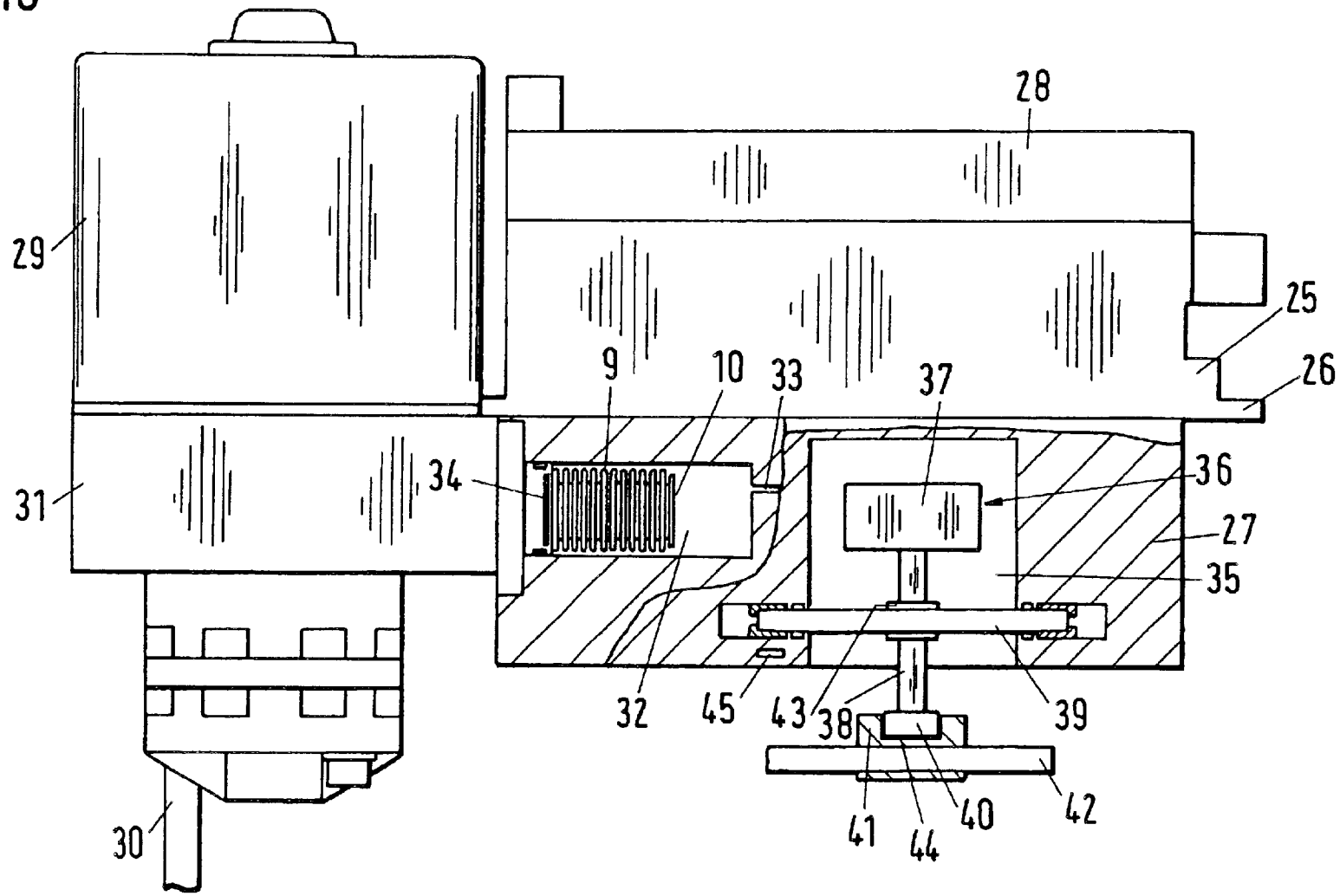
FIG. 16 shows partially in an end view and partially in section a control device for transmissions of motor vehicles with the storage device according to FIG. 15.

FIGS. 15 and 16 show a bellows storage device which is mounted in an electronic-hydraulic control device for automatically controlled manual transmissions of motor vehicles. The control device can be used generally for transmissions, for example, also for twin-clutch transmissions. The control device has a magnetic housing 25 in which solenoids are arranged (not illustrated). The solenoid housing 25 rests with flange 26 against a transmission housing (not illustrated) and is attached thereto in a seal-tight way. By means of the solenoids arranged in the solenoid housing 25 one or several clutches can be actuated and gears and gutters of the transmission can be selected. The control device with hydraulic housing 27 projects through a mounting opening of the transmission housing; the housing 27 is connected in a seal-tight way to the magnet housing 25 arranged externally on the transmission housing. A cover 28 is placed onto the solenoid housing 25 and covers electronic components arranged underneath.

The hydraulic medium which is controlled by the solenoids arranged in the solenoid housing 25 is conveyed by means of a pump arranged on the underside of a motor 29. The pump is positioned within the transmission housing while the motor 29 projects to the exterior. Most of the motor 29 is located outside of the transmission housing. A line 30 is connected to the pump and the hydraulic medium is taken in via this line, as is known in the art. The hydraulic medium is advantageously transmission fluid which is present in the transmission housing.

The hydraulic housing 27 has a lateral projection 31 which is positioned within the transmission housing. The pump is connected to its underside and the motor 29 to its top side. The pressure medium which is conveyed by the pump flows via at least one line (not illustrated) to the solenoids in the hydraulic housing 27. The bellows element 9, 10 is integrated into the control device. It is arranged in a receptacle 32 of the solenoid housing 25. A pressure bore 33 for supplying the pressure medium opens into the receptacle 32. The bellows 9 is fastened to the housing bottom 34 of the receptacle 32. Depending on the pressure of the hydraulic medium within the receptacle 32, the bellows 9 is compressed to a greater or lesser extent.

The hydraulic housing 27 has a receptacle 35 for an actuating device 36 that acts as a gear selector for selecting the gutters and the gears of the transmission. The actuating device 36 has a U-shaped control element 37 positioned in the receptacle 35 which can be moved by means of actuating elements (not illustrated) transversely to the plane of the drawing. These actuating elements can be piston-cylinder units having piston rods engaging the legs of the control element 37. Between the legs of the control element 37 a spherical end of a two-arm switching lever 38 is positioned which is supported on a shaft 39 penetrating the receptacle 35 perpendicularly to the switching lever 38 and supported with its two ends in the hydraulic housing 27. The shaft 39 extends parallel to the longitudinal axis of the control element 37.

The end of the switching lever 38 projecting downwardly from the receptacle 35 supports a coupling member 40 with which the switching lever 38 can be coupled to switching fingers 41 which are seated fixedly on switching shafts 42 of the transmission extending parallel to one another. FIG. 16 shows only one of the switching shafts 42.

The switching lever 38 is positioned on the shaft 39 and is axially slidable by means of a bushing 43. For moving it, two adjusting members (not illustrated) are provided which engage the right and left end faces of the control element 37 (FIG. 16); the adjusting members are preferably pressure-loaded pistons. Depending on the load of these adjusting members, the control element 37 and also the switching lever 38 are moved on the shaft 39 in the desired direction. Since the coupling member 40 of the switching lever 38 engages the selected switching finger 4O of the corresponding switching shaft 42, the switching shaft 42 is also moved in the desired direction.

First, the U-shaped control element 37 is pivoted about the shaft 39 so that the coupling member 40 engages the corresponding coupling receptacle 44 of the switching finger 41 of the corresponding switching shaft 42. By pivoting the switching lever 38 about the shaft 39, the switching shaft 42 designated for a certain gutter of the transmission is coupled by means of the coupling member 40 with the switching lever 38. As soon as the gutter of the transmission has been selected, the control element 37 is moved by the adjusting members (not illustrated) so that by movement of the selected switching shaft 42 the gear available in selected gutter is selected.

In order to detect the required pivot path of the switching lever 38 when selecting the gutter and the required displacement stroke of the switching lever 38 for selecting the desired gear, the shaft 39 has correlated therewith at least one sensor 45, preferably a PLCD sensor (permanent magnet linear displacement sensor) which is arranged in the hydraulic housing 27.

Since the bellows element 9, 10 is arranged within the control device, a compact configuration is provided.

FIG. 15 shows the bellows element 9, 10 in the receptacle 32. It is filled with hydraulic medium at the respective system pressure. FIG. 15 shows the situation where the hydraulic medium in the receptacle 32 is at maximum system pressure $p_{max}$. When the system pressure drops to minimum system pressure $p_{min}$, the bellows element 9, 10 expands to such an extent that the bottom part 10 closes off the bore 33.

The bellows element 9, 10 according to FIG. 15 and FIG. 16 can be configured in the same way as described in the preceding embodiments. In particular, the bellows storage device can contain not only the gas 12 but also the incompressible medium 13 or the solid body 14.

Figure 17:
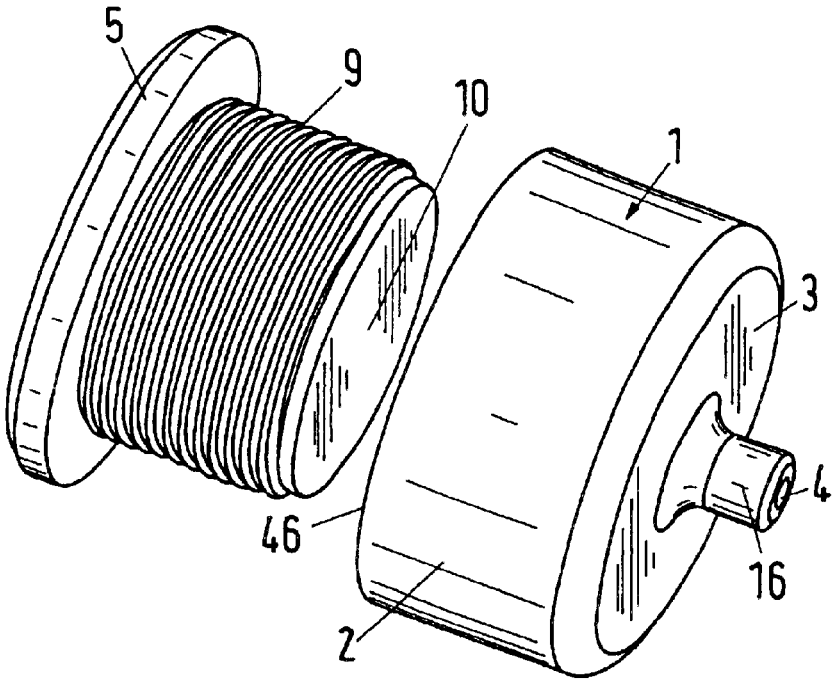
FIG. 17 shows an exploded view of an embodiment of the storage device according to the present invention.

FIG. 17 shows an exploded view of a bellows storage device with bellows 9 which is closed off at one end by the bottom part 10 and with the other end is fastened in a pressure-tight way to the lid 5. The chamber is delimited by the lid 5, the bellows 9, and the bottom part 10. The chamber contains the gas, optionally together with the incompressible medium 13 and the solid body 14. This bellows storage device is inserted as a pre-mounted unit into the housing 1. The housing comprises the housing bottom 3 with the projection 16 in which the opening 4 is provided with which the pressure medium can reach the interior 11 of the housing 1. The end face 46 of the jacket 2 of the housing 1 is connected pressure-tightly to the lid 5 which preferably has the same contour as the housing jacket 2.

While specific embodiments of the invention have been shown and described in detail to illustrate the inventive principles, it will be understood that the invention may be embodied otherwise without departing from such principles.

What is claimed is:

1. A storage device for liquid medium, the storage device comprising:

a housing having an interior provided with at least one partitioning element dividing the interior into a first chamber for receiving the liquid medium and into a second chamber filled at least partially with a gas under pressure, wherein the gas keeps the liquid medium in the first chamber under pressure;

wherein the housing has a pressure connector configured to allow the liquid medium to flow into and out of the first chamber;

wherein the at least one partitioning element comprises an expandable bellows and a bottom part, wherein the bellows and the bottom part delimit the second chamber relative to the first chamber, wherein the bottom part has an end position in which end position the bottom part closes off the pressure connector to prevent the liquid medium from flowing in and out of the first chamber.

2. The storage device according to claim 1, further comprising a lid, wherein the bellows is fastened pressure-tightly to the lid.

3. The storage device according to claim 2, wherein the lid is a lid of the housing pressure-tightly closing the interior receiving the bellows.

4. The storage device according to claim 2, wherein the lid projects past the bellows in a direction transversely to an axis of the bellows.

5. The storage device according to claim 1, wherein the at bottom part is connected pressure-tightly to the bellows.

6. The storage device according to claim 5, wherein the second chamber is delimited by a part of the lid, the bellows, and the bottom part.

7. The storage device according to claim 6, wherein the housing surrounds the bellows at a spacing.

8. The storage device according to claim 6, wherein the housing has a housing bottom and wherein the housing bottom has at least one pressure connector, wherein the liquid medium is supplied to the first chamber via the at least one pressure connector.

9. The storage device according to claim 8, wherein the bottom part closes off the pressure connector when the liquid medium in the first chamber is at minimum pressure.

10. The storage device according to claim 2, wherein the lid is provided with at least one closable filling opening.

11. The storage device according to claim 10, wherein the second chamber contains in addition to the gas an incompressible medium.

12. The storage device according to claim 11, wherein the incompressible medium is a liquid.

13. The storage device according to claim 10, further comprising a solid body arranged in the second chamber.

14. The storage device according to claim 13, wherein the solid body has at least one opening connecting the filling opening of the lid to the second chamber.

15. The storage device according to claim 13, wherein the solid body is attached to the lid.

16. The storage device according to claim 1, wherein the housing has a plane bottom.

17. The storage device according to claim 1, wherein the housing has a curved bottom.

18. The storage device according to claim 1, wherein the bellows is comprised of steel.

19. The storage device according to claim 18, wherein the bellows is comprised of stainless steel.

20. A control device for an automatically controlled manual transmission of a motor vehicle, the control device comprising an actuating device that acts as a gear selector for selecting the gutters and the gears of the transmission, the control device further comprising a storage device comprising a first chamber and a second chamber separated from one another, wherein the second chamber is a pressure chamber arranged in a receptacle of a magnet housing for solenoids, wherein the receptacle forms the first chamber of the storage device and has a pressure connector allowing a medium to flow in and out of the receptacle, wherein the pressure chamber is delimited by a bellows relative to the receptacle and is filled with a gas under pressure, and wherein the bellows has a moveable end closed off by a bottom part, wherein the bottom part has an end position in which end position the bottom part closes off the pressure connector of the solenoid housing to prevent the medium from flowing in and out of the receptacle.

21. The control device according to claim 20, wherein the bottom part closes off the pressure connector when a pressure of the medium in the receptacle reaches a minimum system pressure.

* * * * *